US006253876B1

(12) United States Patent
Cosgrave et al.

(10) Patent No.: US 6,253,876 B1
(45) Date of Patent: Jul. 3, 2001

(54) LADDER STABILIZER APPARATUS

(76) Inventors: Gerard M. Cosgrave, 70 Bolton St., Lindenhurst, NY (US) 11757; Leonard Faught, 134-29 Hawtree St., Ozone Park, NY (US) 11417

( * ) Notice: Subject to any disclaimer, the term of this patent is extended or adjusted under 35 U.S.C. 154(b) by 0 days.

(21) Appl. No.: 09/522,508

(22) Filed: Mar. 10, 2000

(51) Int. Cl.[7] ..... E06C 1/14
(52) U.S. Cl. ..... 182/180.2; 182/107; 182/172
(58) Field of Search ..... 182/180.2, 180.3, 182/107, 45, 172; 248/237

(56) References Cited

U.S. PATENT DOCUMENTS

| | | | | |
|---|---|---|---|---|
| D. 373,428 | | 9/1996 | Nashleanas et al. . | |
| 1,672,020 | | 7/1928 | Brugner . | |
| 2,496,556 | * | 2/1950 | Nelson | 248/237 |
| 4,147,231 | | 4/1979 | Chantler et al. . | |
| 4,244,446 | * | 1/1981 | Mair | 182/172 |
| 4,311,207 | | 1/1982 | Lurry . | |
| 4,519,477 | | 5/1985 | Ralston . | |
| 5,086,876 | * | 2/1992 | Severson | 182/172 |
| 5,622,238 | | 4/1997 | Farmer . | |
| 5,647,451 | * | 7/1997 | Reichel | 182/45 |
| 6,045,102 | * | 4/2000 | Terenzoni | 182/107 |
| 6,053,284 | * | 4/2000 | Fountain | 182/180.2 |

* cited by examiner

*Primary Examiner*—Alvin Chin-Shue

(57) ABSTRACT

A ladder stabilizer apparatus for preventing a ladder from slipping upon the ground while the user is moving upon the ladder. The ladder stabilizer apparatus includes includes a pair of elongate horizontally-disposed base member each of which has a first channel defined by a pair of side walls spaced apart and having a plurality of holes extending therethrough and along the length thereof; and also includes a plurality of elongate support members each having a pair of bores near the ends thereof; and further includes a pair of elongate bracket members each of which includes a second channel defined by a pair of side walls spaced apart and having a plurality of holes extending therethrough and along the length thereof with each bracket member being adapted to securely mount to a respective rail of a ladder; and also includes a plurality of springs each of which is securely disposed in a respective bore and includes a plurality of pin-like locking members biasedly disposed in the ends of the bores for fastening the support members in the channels of both the base members and the bracket members.

19 Claims, 3 Drawing Sheets

LADDER STABILIZER APPARATUS

BACKGROUND OF THE INVENTION

1. Field of the Invention

The present invention relates to a ladder locking mechanism and more particularly pertains to a new ladder stabilizer apparatus for preventing a ladder from slipping upon the ground while the user is moving upon the ladder.

2. Description of the Prior Art

The use of a ladder locking mechanism is known in the prior art. More specifically, a ladder locking mechanism heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,519,477; U.S. Pat. No. 4,147,231; U.S. Pat. No. 4,311,207; U.S. Pat. No. Des. 373,428; U.S. Pat. No. 1,672,020; and U.S. Pat. No. 5,622,238.

While these devices fulfill their respective, particular objectives and requirements, the aforementioned patents do not disclose a new ladder stabilizer apparatus. The inventive device includes a pair of elongate horizontally-disposed base member each of which has a first channel defined by a pair of side walls spaced apart and having a plurality of holes extending therethrough and along the length thereof; and also includes a plurality of elongate support members each having a pair of bores near the ends thereof; and further includes a pair of elongate bracket members each of which includes a second channel defined by a pair of side walls spaced apart and having a plurality of holes extending therethrough and along the length thereof with each bracket member being adapted to securely mount to a respective rail of a ladder; and also includes a plurality of springs each of which is securely disposed in a respective bore and includes a plurality of pin-like locking members biasedly disposed in the ends of the bores for fastening the support members in the channels of both the base members and the bracket members.

In these respects, the ladder stabilizer apparatus according to the present invention substantially departs from the conventional concepts and designs of the prior art, and in so doing provides an apparatus primarily developed for the purpose of preventing a ladder from slipping upon the ground while the user is moving upon the ladder.

SUMMARY OF THE INVENTION

In view of the foregoing disadvantages inherent in the known types of ladder locking mechanism now present in the prior art, the present invention provides a new ladder stabilizer apparatus construction wherein the same can be utilized for preventing a ladder from slipping upon the ground while the user is moving upon the ladder.

The general purpose of the present invention, which will be described subsequently in greater detail, is to provide a new ladder stabilizer apparatus which has many of the advantages of the ladder locking mechanism mentioned heretofore and many novel features that result in a new ladder stabilizer apparatus which is not anticipated, rendered obvious, suggested, or even implied by any of the prior art ladder locking mechanism, either alone or in any combination thereof.

To attain this, the present invention generally comprises includes a pair of elongate horizontally-disposed base member each of which has a first channel defined by a pair of side walls spaced apart and having a plurality of holes extending therethrough and along the length thereof; and also includes a plurality of elongate support members each having a pair of bores near the ends thereof; and further includes a pair of elongate bracket members each of which includes a second channel defined by a pair of side walls spaced apart and having a plurality of holes extending therethrough and along the length thereof with each bracket member being adapted to securely mount to a respective rail of a ladder; and also includes a plurality of springs each of which is securely disposed in a respective bore and includes a plurality of pin-like locking members biasedly disposed in the ends of the bores for fastening the support members in the channels of both the base members and the bracket members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder stabilizer apparatus which has many of the advantages of the ladder locking mechanism mentioned heretofore and many novel features that result in a new ladder stabilizer apparatus which is not anticipated, rendered obvious, suggested, or even implied by any of the prior art ladder locking mechanism, either alone or in any combination thereof.

It is another object of the present invention to provide a new ladder stabilizer apparatus which may be easily and efficiently manufactured and marketed.

It is a further object of the present invention to provide a new ladder stabilizer apparatus which is of a durable and reliable construction.

An even further object of the present invention is to provide a new ladder stabilizer apparatus which is susceptible of a low cost of manufacture with regard to both materials and labor, and which accordingly is then susceptible of low prices of sale to the consuming public, thereby making such ladder stabilizer apparatus economically available to the buying public.

Still yet another object of the present invention is to provide a new ladder stabilizer apparatus which provides in the apparatuses and methods of the prior art some of the advantages thereof, while simultaneously overcoming some of the disadvantages normally associated therewith.

Still another object of the present invention is to provide a new ladder stabilizer apparatus for preventing a ladder from slipping upon the ground while the user is moving upon the ladder.

Yet another object of the present invention is to provide a new ladder stabilizer apparatus which includes includes a pair of elongate horizontally-disposed base member each of which has a first channel defined by a pair of side walls spaced apart and having a plurality of holes extending therethrough and along the length thereof; and also includes a plurality of elongate support members each having a pair of bores near the ends thereof; and further includes a pair of elongate bracket members each of which includes a second channel defined by a pair of side walls spaced apart and having a plurality of holes extending therethrough and along the length thereof with each bracket member being adapted to securely mount to a respective rail of a ladder; and also includes a plurality of springs each of which is securely disposed in a respective bore and includes a plurality of pin-like locking members biasedly disposed in the ends of the bores for fastening the support members in the channels of both the base members and the bracket members.

Still yet another object of the present invention is to provide a new ladder stabilizer apparatus that safely and conveniently prevents accidents by preventing the ladder from slipping while the user is using it.

Even still another object of the present invention is to provide a new ladder stabilizer apparatus that can be easily and quickly adjusted for any situation that the ladder is being used.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
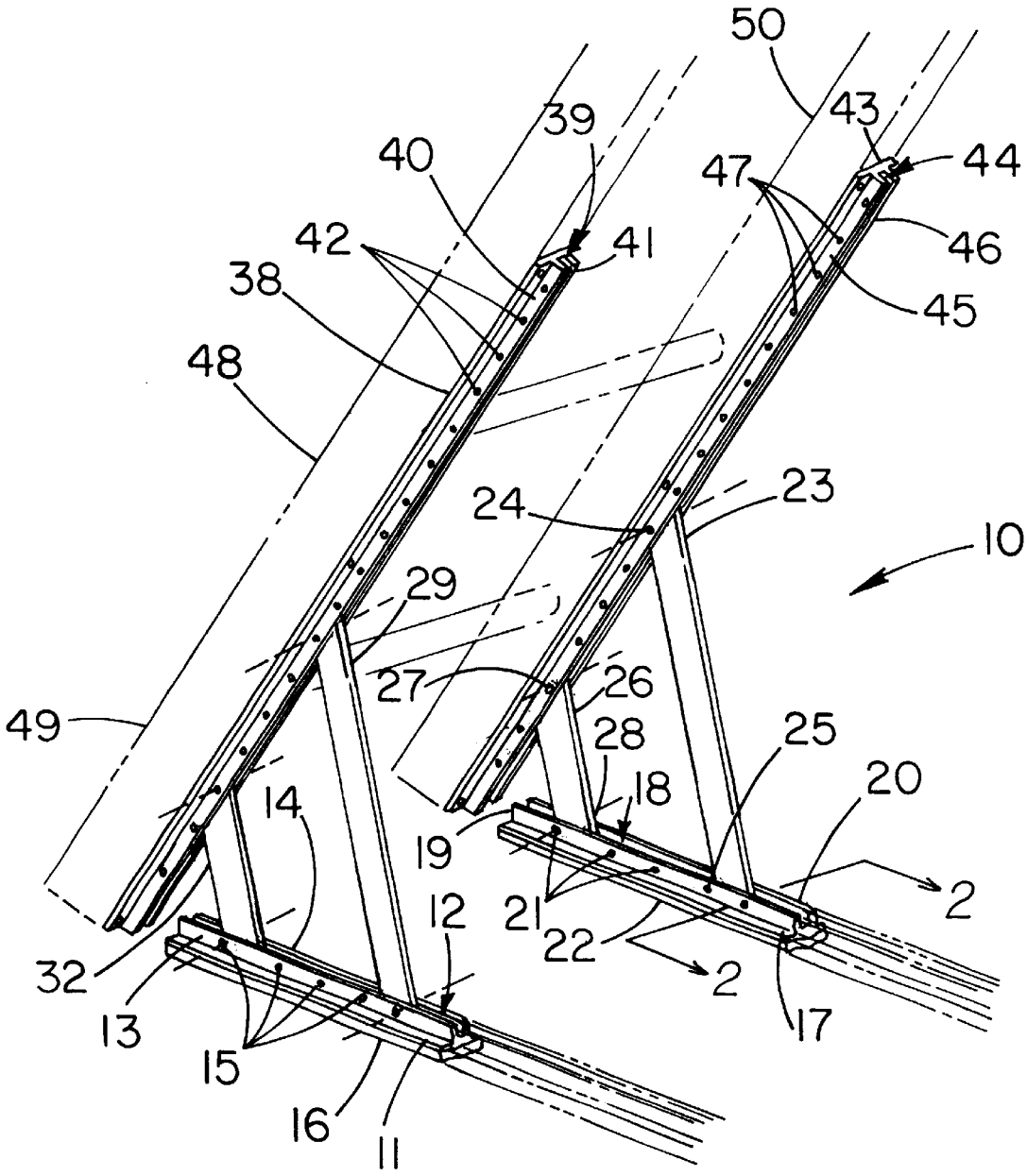
FIG. 1 is a perspective view of a new ladder stabilizer apparatus according to the present invention and shown in use.
Figure 2:
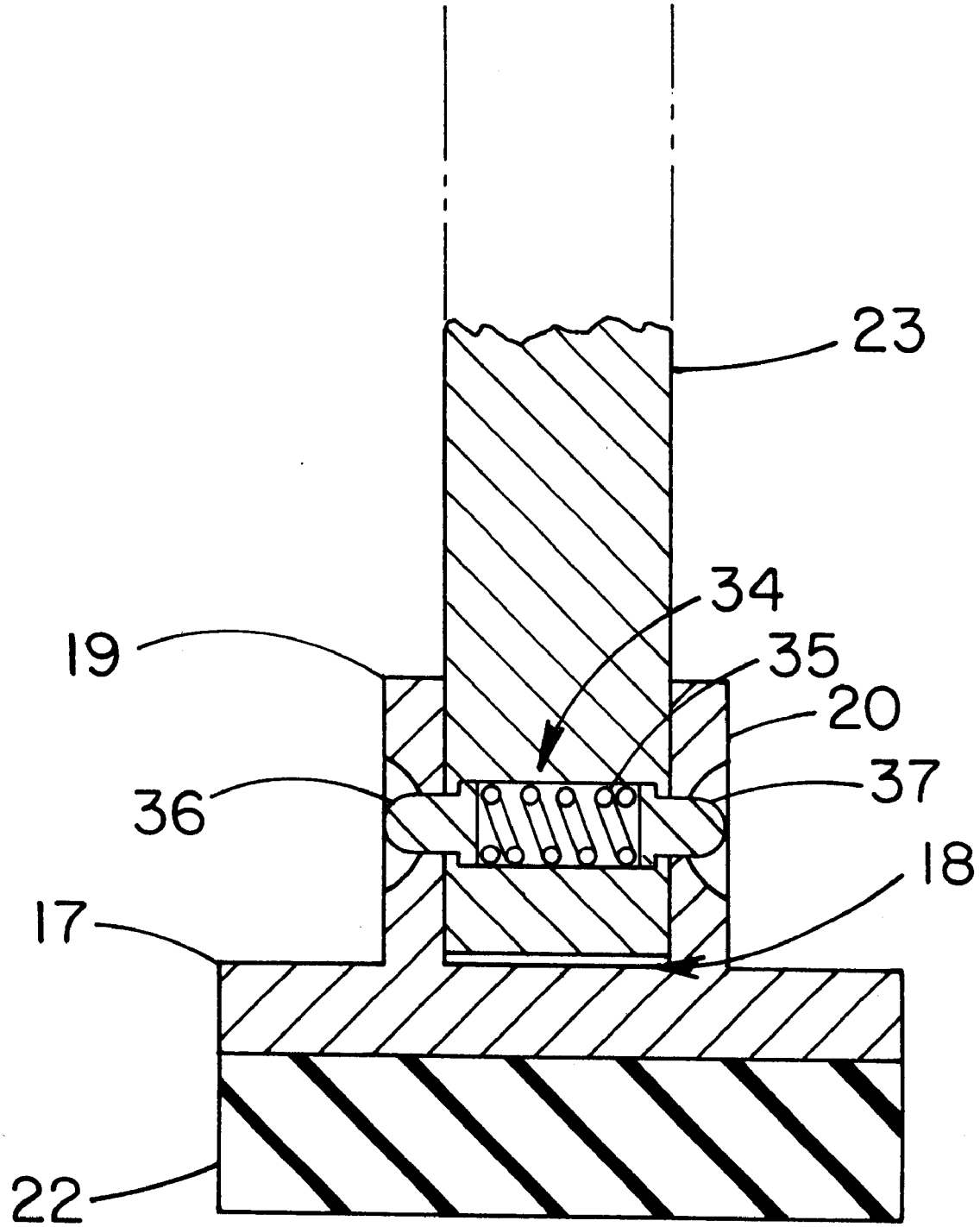
FIG. 2 is a cross-sectional view of the one of the base member and one of the support members of the present invention.
Figure 3:
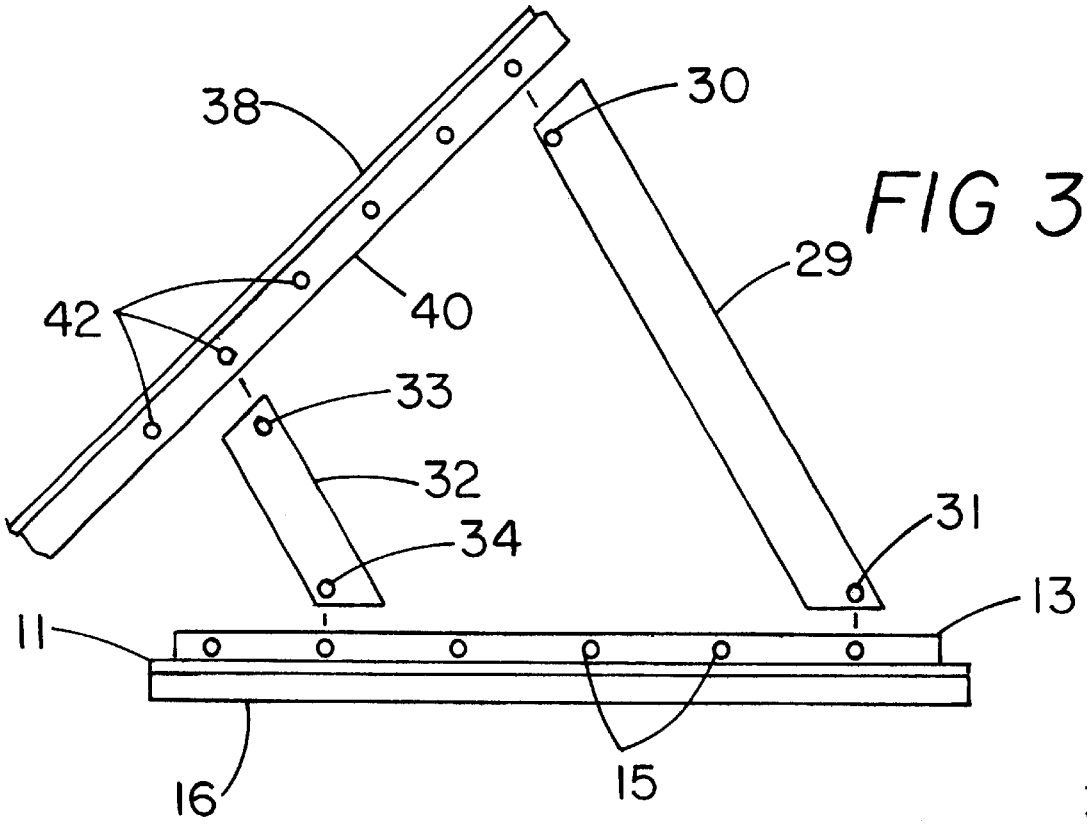
FIG. 3 is an exploded side elvational view of the present invention.
Figure 4:
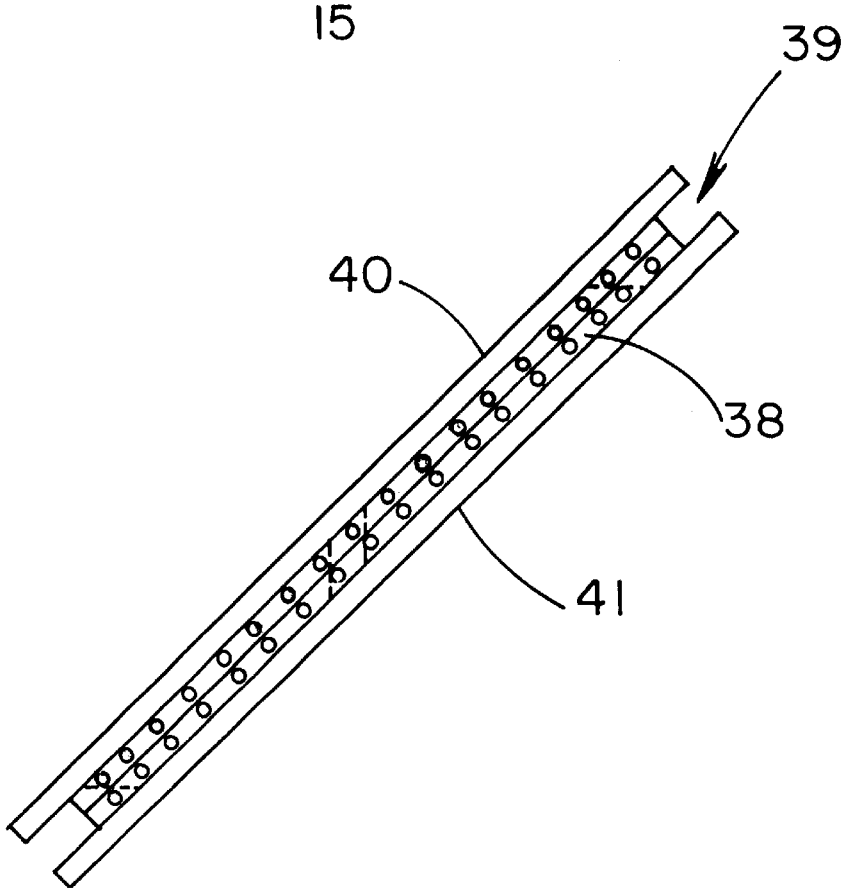
FIG. 4 is a bottom plan view of one of the bracket members of the present invention.

With reference now to the drawings, and in particular to FIGS. 1 through 4 thereof, a new ladder stabilizer apparatus embodying the principles and concepts of the present invention and generally designated by the reference numeral 10 will be described.

As best illustrated in FIGS. 1 through 4, the ladder stabilizer apparatus 10 generally comprises a pair of elongate horizontally-disposed base members 11,17 each of which includes a first channel 12,18 defined by a pair of side walls 13,14,19,20 spaced apart and integrally extending upwardly and along a length of a respective base member 11,17. The base members 11,17 are adapted to rest upon a ground. Each of the base members 11,17 includes a bottom side having an elongate non-slip member 16,22 securely and conventionally attached thereto for preventing the respective base member 11,17 from slipping upon the ground. The side walls 13,14,19,20 of the first channel 12,18 include a plurality of holes 15, 21 extending therethrough and spaced therealong with each of the non-slip members 16,22 being essentially made of rubber.

The ladder stabilizer apparatus 10 also includes a plurality of elongate support members 23,26,29,32 each of which has a first end pivotally and securely fastened in the first channel 12,18 of a respective base member 11,17 and each of which also having a second end. The elongate support members 23,26,29,32 includes a first pair 26,32 of the support members and a second pair 23,29 of the support members which are relatively longer than the first pair 26,32 of the support members. One 29 of the first pair of the support members is securely fastened to one 17 of the base members and the other 32 of the first pair of the support members is securely fastened to the other 11 of the base members. One 23 of the second pair of the support members is securely fastened to one 17 of the base members and the other 29 of the second pair of the support members is securely fastened to the other 11 of the base members.

The ladder stabilizer apparatus 10 further includes a pair of elongate bracket members 38,43 each of which is adapted to securely and conventionally attach with bolts and screws to a respective rail 49,50 of a ladder 48 and each of which includes a second channel 39,44 defined by a pair of side walls 40,41,45,46 spaced apart and extending outwardly of the respective bracket member 38,43. The second end of each of the elongate support members 23,26,29,32 is pivotally and securely fastened in the second channel 39,44 of a respective one of the elongate bracket members 38,43. The side walls 40,41,45,46 of the second channel include a plurality of holes 42,47 extending therethrough and being spaced therealong. Each of the support members 23,26,29, 32 includes a pair of bores 24,25,27,28,30,31,33,34 one of which extends laterally therethrough near the first end and the other of which extends laterally therethrough near the second end.

A means for removably and adjustably fastening the elongate support members 23,26,29,32 to the base members 11,17 and to the bracket members 38,43 includes a plurality of springs 35 each of which is conventionally disposed in a respective bore, and also includes a plurality of pin-like locking members 36,37, each pair of which are movably and biasedly disposed through ends of a respective one of the bores with one of the pair being movably disposed from one of the ends of the bore and with the other of the pair being movably disposed from the other of the ends of the bore. The pin-like locking members 36,37 are removably received in the holes 15,21,42,47 of the side walls of the first and second channels. Each of the pin-like locking members 36,37 includes an annular flange integrally disposed at one end thereof and further includes a parabolic end at an opposite end thereof. The annular flange is adapted to prevent the pin-like locking member 36,37 from being removed from a respective bore.

In use, the ladder stabilizer apparatus 10 is set up between the wall structure and the ladder 48 with the base members 11,17 each being placed upon the ground and in alignment with a respective rail 49,50 of the ladder 48. The user then removably fastens the support members 23,26,29,32 in the first channels 12,18 of the base members 11,17 and also in the second channels 39,44 of the bracket members 38,43 which are securely mounted to the rails 49,50 of the ladder 48. The ladder stabilizer apparatus 10 prevents the ladder 48 from slipping upon the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A ladder stabilizer apparatus comprising:

a pair of elongate horizontally-disposed base members each of which includes a first channel defined by a pair of side walls spaced apart and extending upwardly and along a length of a respective said base member, said base member being adapted to rest upon a ground, each of said base members including a bottom side having an elongate non-slip member securely attached thereto for preventing said respective base member from slipping upon the ground;

a plurality of elongate support members each of which having a first end pivotally and securely fastened in said first channel of a respective said base member and each of which also having a second end;

a pair of elongate bracket members each of which is adapted to securely attach to a respective rail of a ladder and each of which includes a second channel defined by a pair of side walls spaced apart and extending outwardly of said respective bracket member, said second end of each of said elongate support members being pivotally and securely fastened in said second channel of a respective one of said elongate bracket members;

a means for removably and adjustably fastening said elongate support members to said base members and to said bracket members; and wherein said elongate support members includes a first pair of said support members and a second pair of said support members which are relatively longer than said first pair of said support members.

2. A ladder stabilizer apparatus as described in claim 1, wherein said side walls of said first channel includes a plurality of holes extending therethrough and spaced therealong.

3. A ladder stabilizer apparatus as described in claim 1, wherein one of said first pair of said support members is securely fastened to one of said base members and the other of said first pair of said support members is securely fastened to the other of said base members.

4. A ladder stabilizer apparatus as described in claim 1, wherein one of said second pair of said support members is securely fastened to one of said base members and the other of said second pair of said support members is securely fastened to the other of said base members.

5. A ladder stabilizer apparatus as described in claim 1, wherein said side walls of said second channel includes a plurality of holes extending therethrough and being spaced therealong.

6. A ladder stabilizer apparatus as described in claim 1, wherein each of said support members includes a pair of bores, one of which extends laterally therethrough near said first end and the other of which extends laterally therethrough near said second end.

7. A ladder stabilizer apparatus as described in claim 6, wherein said means for removably and adjustably fastening said support members to said base members and to said bracket members includes a plurality of springs each of which is disposed in a respective said bore, and also includes a plurality of pin-like locking members each pair of which are movably and biasedly disposed through ends of a respective one of said bores with one of said pair being movably disposed from one of said ends of said bore and with the other of said pair being movably disposed from the other of said ends of said bore, said pin-like locking members being removably received in a plurality of holes formed in said side walls of said first and second channels.

8. A ladder stabilizer apparatus as described in claim 7, wherein each of said pin-like locking members includes an annular flange at one end thereof and further includes a parabolic end at an opposite end thereof, said annular flange being adapted to prevent said pin-like locking member from being removed from a respective said bore.

9. A ladder stabilizer apparatus as described in claim 8, wherein each of said non-slip members is essentially made of rubber.

10. A ladder stabilizer apparatus comprising:

a pair of elongate horizontally-disposed base members each of which includes a first channel defined by a pair of side walls spaced apart and extending upwardly and along a length of a respective said base member, said base member being adapted to rest upon a ground;

a plurality of elongate support members each of which having a first end pivotally and securely fastened in said first channel of a respective said base member and each of which also having a second end;

a pair of elongate bracket members each of which is adapted to securely attach to a respective rail of a ladder and each of which includes a second channel defined by a pair of side walls spaced apart and extending outwardly of said respective bracket member, said second end of each of said elongate support members being pivotally and securely fastened in said second channel of a respective one of said elongate bracket members;

a means for removably and adjustably fastening said elongate support members to said base members and to said bracket members; and wherein said elongate support members including a first pair of said support members and a second pair of said support members which are relatively longer than said first pair of said support members.

11. A ladder stabilizer apparatus as described in claim 10, wherein said side walls of said first channel includes a plurality of holes extending therethrough and spaced therealong.

12. A ladder stabilizer apparatus as described in claim 10, wherein one of said first pair of said support members is securely fastened to one of said base members and the other of said first pair of said support members is securely fastened to the other of said base members.

13. A ladder stabilizer apparatus as described in claim 10, wherein one of said second pair of said support members is securely fastened to one of said base members and the other of said second pair of said support members is securely fastened to the other of said base members.

14. A ladder stabilizer apparatus as described in claim 10, wherein said side walls of said second channel includes a plurality of holes extending therethrough and being spaced therealong.

15. A ladder stabilizer apparatus as described in claim 10, wherein each of said support members includes a pair of bores, one of which extends laterally therethrough near said first end and the other of which extends laterally therethrough near said second end.

16. A ladder stabilizer apparatus as described in claim 6, wherein said means for removably and adjustably fastening s aid support members to said base members and to said bracket members includes a plurality of springs each of which is disposed in a respective said bore, and also includes a plurality of pin-like locking member s each pair of which are movably and biasedly disposed through ends of a respective one of said bores with one of said pair being movably disposed from one of said ends of said bore and with the other of said pair being movably disposed from the other of said ends of said bore, said pin-like locking members being removably received in a plurality of holes formed in said side walls of said first and second channels.

17. A ladder stabilizer apparatus as described in claim 16, wherein each of said pin-like locking members includes an annular flange at one end thereof and further includes a parabolic end at an opposite end thereof, said annular flange being adapted to prevent said pin-like locking member from being re moved from a respective said bore.

18. A ladder stabilizer apparatus as described in claim 10, wherein each of said non-slip members is essentially made of rubber.

19. A ladder stabilizer apparatus comprising:

a pair of elongate horizontally-disposed base members each of which includes a first channel defined by a pair of side walls spaced apart and extending upwardly and along a length of a respective said base member, said base member being adapted to rest upon a ground, each of said base members including a bottom side having an elongate non-slip member securely attached thereto for preventing said respective base member from slipping upon the ground, said side walls of said first channel including a plurality of holes extending therethrough and spaced therealong, each of said non-slip members being essentially made of rubber;

a plurality of elongate support members each of which having a first end pivotally and securely fastened in said first channel of a respective said base member and each of which also having a second end, said elongate support members including a first pair of said support members and a second pair of said support members which are relatively longer than said first pair of said support members, one of said first pair of said support members being securely fastened to one of said base members and the other of said first pair of said support members being securely fastened to the other of said base members, one of said second pair of said support members being securely fastened to one of said base members and the other of said second pair of said support members being securely fastened to the other of said base members;

a pair of elongate bracket members each of which is adapted to securely attach to a respective rail of a ladder and each of which includes a second channel defined by a pair of side walls spaced apart and extending outwardly of said respective bracket member, said second end of each of said elongate support members being pivotally and securely fastened in said second channel of a respective one of said elongate bracket members, said side walls of said second channel including a plurality of holes extending therethrough and being spaced therealong, each of said support members including a pair of bores, one of which extends laterally therethrough near said first end and the other of which extends laterally therethrough near said second end; and a means for removably and adjustably fastening said elongate support members to said base members and to said bracket members including a plurality of springs each of which is disposed in a respective said bore, and also including a plurality of pin-like locking members each pair of which are movably and biasedly disposed through ends of a respective one of said bores with one of said pair being movably disposed from one of said ends of said bore and with the other of said pair being movably disposed from the other of said ends of said bore, said pin-like locking members being removably received in said holes of said side walls of said first and second channels, each of said pin-like locking members including an annular flange at one end thereof and further including a parabolic end at an opposite end thereof, said annular flange being adapted to prevent said pin-like locking member from being removed from a respective said bore.

* * * * *